United States Patent [19]

Beavers

[11] 4,077,417

[45] Mar. 7, 1978

[54] COMBINATION TENT AND FRAME THEREFOR

[75] Inventor: Allan E. Beavers, Littleton, Colo.

[73] Assignee: T. A. Pelsue Company, Englewood, Colo.

[21] Appl. No.: 692,538

[22] Filed: Jun. 3, 1976

[51] Int. Cl.[2] ..... A45F 1/16

[52] U.S. Cl. ..... 135/3 R; 135/4 R; 135/15 PQ; 135/DIG. 9

[58] Field of Search ..... 135/3 R, 3 E, 4 R, 15 PQ, 135/DIG. 9; 403/172, 176, 217, 218, 223

[56] References Cited

U.S. PATENT DOCUMENTS

| | | | |
|---|---|---|---|
| 1,231,735 | 7/1917 | Harris | 135/7.1 R |
| 1,773,847 | 8/1930 | Nickles | 135/4 R |
| 1,853,367 | 4/1932 | Mace | 135/4 R |
| 3,941,140 | 3/1976 | Beavers | 135/4 R |

FOREIGN PATENT DOCUMENTS

| | | | |
|---|---|---|---|
| 1,086,154 | 10/1967 | United Kingdom | 135/3 R |

*Primary Examiner*—Werner H. Schroeder
*Assistant Examiner*—Conrad L. Berman
*Attorney, Agent, or Firm*—Edwin L. Spangler, Jr.

[57] ABSTRACT

This invention relates to a novel tent construction characterized by at least two, and preferably four, identical subframes, each pair of which is connected together at the adjacent upper outside corners to produce in unfolded condition an inverted generally V-shaped frame when the lower marginal edges thereof are maintained in maximum fixed-spaced relation to one another by a foldable fabric floor stretched therebetween. When four subframes are employed, the second pair is connected to the first in end-to-end relation so as to double the length of the resulting frame. Each subframe includes a unique molded hub at the center thereof having four equiangularly-spaced sockets therein shaped to receive a ball on the inner end of a springable rib-forming strut for movement between a folded position nested alongside one another and an unfolded position arching radially therefrom in umbrella-like fashion. The fabric covering stretched over the subframe cooperates therewith to not only maintain the rib-forming struts in arched umbrella-like fashion when unfolded, but additionally, to keep the ends thereof seated in sockets in the hub and connectors therefor. Socketed connectors adapted to detachably receive the outer ends of the upper struts of each pair of interconnected subframes for foldable movement are provided along the ridge of the tent, these connectors differing from the hub in that the webs separating the sockets are sufficiently thin and flexible to permit the sockets themselves to move between an essentially radial coplanar relationship into a non-planar one in which they approach a parallel relationship to one another. In the embodiment where four subframes are employed, the middle connector of the three on the ridge has four sockets while those at opposite ends have only two. Double-socketed connectors similar in construction and operation to those used at the ends of the ridge are found at the base of the frame connecting the adjacent pairs of subframes together.

20 Claims, 13 Drawing Figures

COMBINATION TENT AND FRAME THEREFOR

In my U.S. Pat. No. 3,810,482 I disclose a tent frame made up from a plurality of identical subframe assemblies connected together along a common edge to define sidewall and roof-supporting structures. Each of these subframes included, in the particular form shown therein, four equiangularly-spaced rib-forming struts hingedly connected to a common central hub for movement between a folded condition in which the struts lie in nested side-by-side relation and an unfolded condition in which they radiate out from the hub and bear an angular relationship to their opposite counterpart in the subframe of something greater than 180°. The struts of my earlier patented construction were essentially rigid and, for this reason, the subframe required as an integral part thereof an elastic cord to be stretched between the outer ends of adjacent struts to maintain them in their unfolded over-center relation.

In the larger tents and even some of the small ones covered with thick, heavy plastic or canvas, the concept of the rigid struts bordered by the stretchable cord is still to be preferred; however, I have now discovered that new lightweight versions of the tent can be advantageously made by replacing the rigid struts with springable ones capable of being bowed into an arched configuration under compression loading supplied by the fabric covering thus eliminating the need for the stretchable cord altogether.

The replacement of the rigid struts with springable ones also occasioned the redesign and simplification of the central hub of the subframe. In my earlier patent alluded to previously, the struts were each hingedly attached to the hub near the center thereof while the marginal portion of the hub defined a stop which limited the unfolded angular relationship between each strut and its opposite counterpart to an angle in excess of 180° but something less than 220° in the usual case. In another of my patents, specifically U.S. Pat. No. 3,941,140, I disclose, among other things, an improved compact version of the central hub in which the rigid struts are hingedly attached thereto in slightly overlapped side-by-side relation in contrast to the coplanar relationship occupied by each pair of diagonally-disposed struts in my first patent identified previously. Both of the hubs disclosed in these issued patents include stop-forming rim portions spaced radially-outward of the hinged connection and they, therefore, function in much the same way to limit the over-center excursion of the struts into unfolded position.

I have now determined that by replacing the rigid struts with springable ones, both the size and the complexity of the central hubs can be reduced in that no stop-forming rim is necessary any longer, but instead, it need only contain sockets for the inner ends of the struts that will allow them to move from their folded side-by-side nested condition into their unfolded arched or bowed condition and vice versa. Connectors having sockets therein with similar capabilities to the hub sockets in terms of strut movement are also used on the outer ends of the struts, those on the ridge, especially the center one of a tent with four subframes, having special features which will be made known presently.

Now, another important distinction between the tents of my earlier patents and that forming the subject matter of the instant one is the new and unexpected cooperative relationship between the subframe and the covering therefor. My patented tent constructions are such that each subframe including the stretchable cord encircling same is capable of maintaining its unfolded condition without any fabric covering. Moreover, four such subframes can be interconnected and deployed to produce a free-standing structure capable of supporting a skin or covering that provides no structural contribution to the assembly whatsoever.

In the instant tent, on the other hand, this is no longer the situation because, once the structural connections between the remote ends of adjacent struts has been eliminated, there is nothing left to maintain the unfolded condition of the subframes or a free-standing structure comprised of a plurality thereof. This is not to say that the subframes could not still be constructed in the manner of my patents by including a cord or the like reaved around the outer strut ends because, obviously, it could. In fact, with the struts being springable, the cord or whatever is employed to maintain the struts in over-center relation, need not even be elastic. Be that as it may, the preferred construction is one in which the cord, stretchable or not, is eliminated altogether and the fabric or skin covering the subframe is connected thereto for the first time in such a way that it cooperates therewith to maintain the struts in their bowed or arched condition when unfolded. It is worthy of note, however, that the fabric covering the subframes coacts therewith in a manner quite different from the stretchable cord of the rigid-strutted frames. In the instant case, the fabric need not stretch because the springable struts will flex to the degrees necessary for them to pass over center into the bowed configuration. This is not to say that the fabric cannot stretch to some degree or even be somewhat elastic, but rather, that such characteristics are unnecessary because the struts themselves are able to flex and accommodate the lack of this capability. From a practical standpoint, most of the lightweight weatherproof coverings employed in tents of the type forming the subject matter hereof are, in fact, stretchable to some greater or lesser degree depending upon their area, thickness and weave such as, for example, Rip-Stop Nylon, etc.

In addition to the cooperative relationship between the subframes and covering therefor just discussed, there is yet another one present in the instant invention, specifically, that of releasably maintaining the struts under a degree of compression loading when in unfolded condition so that the ends thereof remain seated securely in their respective sockets. During assembly, the struts are merely sprung into a bowed relationship such that the ends thereof come close enough together to enter the open sockets at which point they are released and allowed to assume their more or less permanently seated position therein.

The four socket connector in the middle of the ridge of the double length tent along with the two socket connectors employed at the ridge ends in both the single and double length tents are uniquely designed to provide a thin foldable web portion between the sockets that will fold into a pleat when the struts housed therein move from their unfolded position into a folded side-by-side nested relation. Connectors of similar design are used at the midpoints of the base of the double length version of the tent.

Along with these unique structural features, the overall tent design and construction is such that it can be either set up or taken down literally in a matter of a few seconds by inexperienced persons and without the aid of any tools. Ordinarily, the gear such as sleeping bags and the like placed inside the tent are sufficiently heavy to anchor it down, especially when occupied; however, in inclement weather it is best to stake the tent down in the usual manner which activity, obviously, adds a couple of minutes to the few seconds it takes to set the tent up initially. Even this anchoring operation is greatly simplified because the tent is already erected and there is no trial and error process associated with finding the exact location for the stakes, contrary to what one experiences with the ordinary tent. All in all, two or three minutes is ample time to both erect the tent and stake it down.

Since the shell or skin covering the frame comprises an important structural feature of the assembly and is more or less permanently connected thereto, there are no loose parts to lose or assemble other than, perhaps, the stakes if they are needed. Moreover, the design of the tent is such that when folded, all the inside surfaces lie inside the resulting bundle and the underside of the floor, which is the surface most likely to be dirty, forms the outer covering. If, perchance, the outer surfaces are wet when the tent is taken down and packed, the water is free to drain out the end opposite that where the hubs are located and there is little, if any, opportunity for the moisture to reach and wet any of the interior surfaces.

Lastly, the double length version of the tent is large enough and long enough to sleep two six foot-plus adults lying side-by-side in complete comfort with plenty of room; yet, at the same time, it will fold up to produce a neat package weighing only a few pounds that is just over 30 inches in length and about 4 inches in diameter. As such, it can easily be carried by hikers strapped or otherwise secured in upright position alongside their backpacks. Travelers by automobile, motorcycle or even bicycle can carry the tent and set it up whenever and wherever the opportunity or urge to do so hits them. By carrying the tent in the trunk of the car at all times, the occupants are always ready to set up and break camp in a matter of minutes whenever a situation arises where other accommodations are unavailable. While any tent will fulfill such a need, none of them will do so as quickly, easily and with less trouble than the instant one.

It is, therefore, the principal object of the present invention to provide a novel and improved tent, frame and subassembly comprising a subframe and covering therefor.

A second objective is the provision of a novel ground tent wherein the frame, cover therefor and floor cooperate to define a unitary assembly of unique design and construction.

Another object is to provide a tent of the type aforementioned which, in the absence of anchoring, can either be erected or taken down by a single unskilled person using no tools whatsoever in a matter of a few seconds.

Still another objective is the provision of a tent made up of two or more identical subframes together with the covering therefor, each of which springs independently into an unfolded umbrella-like condition where the hubs connecting the adjacent ends of the springable struts are moved in a direction to bring the latter into a position where they define bowed diagonals of a square.

An additional object is to provide a foldable tent structure wherein the fabric covering the subframes constitutes a structural part of the subassembly effective in both the unfolded and folded conditions thereof to maintain the ends of the struts seated in the sockets provided therefor.

Further objects of the invention herein disclosed and claimed are to provide a collapsible tent structure which is compact, lightweight, versatile, rugged, essentially weatherproof, stable, convenient, relatively inexpensive and decorative in appearance.

Other objects will be in part apparent and in part pointed out specifically hereinafter in connection with the description of the drawings that follows, and in which.

Figure 1:
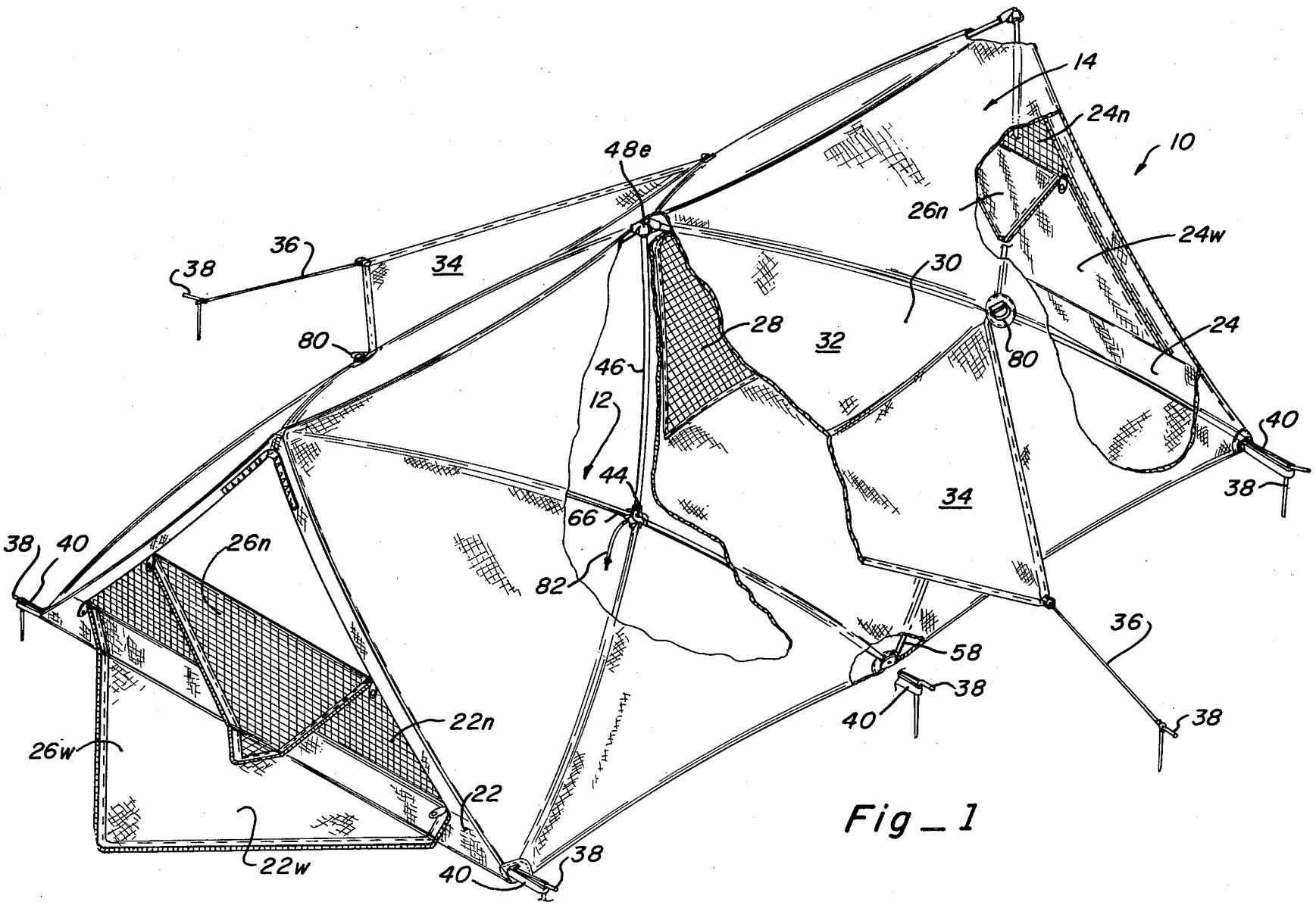
FIG. 1 is a perspective view showing the double length version of the tent erected and staked down, portions of the skin covering the frame having been broken away to reveal the construction of the latter.

Referring next to the drawings for a detailed description of the present invention and, initially, to FIGS. 1–4, inclusive, for this purpose, reference numeral 10 has been chosen to designate the tent in its entirety while numeral 12 broadly refers to the frame thereof and numeral 14 refers in the same general way to the fabric skin that covers the latter. As shown, the skin includes a floor 16, the side margins of which are sewn or otherwise attached to the sidewalls 18 which merge at the top to define a ridge 20. Front wall 22 and rear wall 24 form closures for the open ends of the tent and are permanently sewn to both the sidewalls and the floor so as to cooperate therewith in forming a unitary envelope covering the frame 12.

In the particular form illustrated, both front and rear walls 22 and 24 are double in that they each include an inside netting layer **22*n* and 24*n* covered by an outer weatherproof layer 22*w* and 24*w*. Both layers on at least one end, and preferably both, include zippered flaps 26 which, when both are open, provide for ingress and egress. On the other hand, with the net flap 26*n* closed and the weatherproof flap 26***w* open, ventilation is available.

Net-covered openings 28 in the sidewalls produce windows for additional ventilation. Their location and inclination is such that rain and snow would come into the tent unless they were covered, therefore, a rain fly 30 covers them. This rain fly is shown as comprising a generally diamond-shaped sheet of waterproof fabric, the upper triangular half 32 of which is stitched along the divergent side margins thereof to the sidewall of the tent along the edges of the window. The lower half of the fly constitutes a loose triangular flap 34 which can be pulled out and anchored to the ground as shown by a short length of cord 36 and a tent stake 38. When this is done, the upper half 32 pulls away from the net-covered window underneath and permits air to circulate freely therebetween.

Suitable loops 40 are provided at all four corners and at the midpoint of both sidewalls to receive stakes 38 in case the tent needs to be anchored down in inclement weather. As previously noted, with the tent occupied and/or anchored down with gear, it is possible to use the tent quite satisfactorily without even staking it down. It is probably a good idea under any circumstances to spread the rain flies 30 out and stake them down to provide better air circulation and at least minimal ground anchoring. Also, by so doing, the walls of the tent can "breathe" and most of the moisture will condense on the inside of the fly where it runs off onto the ground without wetting the interior wall and floor surfaces. If the tent is to be used for high altitude shelter under extremely cold conditions, the fly should cover both sidewalls and be held in spaced relation thereto in order to prevent dangerous condensation from forming inside the tent. By the same token, such a fly would project somewhat beyond both ends if the weatherproof integrity thereof is to be preserved. Flies such as that described above for use under severe weather conditions are well known in the art and, for this reason, they form no part of the present invention, it being sufficient to point out that the instant tent could be so equipped by an artisan of ordinary skill should the need therefor arise. For present purposes, the more important aspects of the skin are its structural and functional characteristics in cooperation with the frame.

The floor 16, when stretched taut, limits the extent to which the sidwalls can diverge. In so doing, it also determines the minimum headroom available inside thereof. Integral tent floors have, of course, been performing these functions long before now and, therefore, this feature, likewise, forms no part of the present invention. Furthermore, it will be apparent that many other common instrumentalities can be used in place of the floor to limit the spread of the sidewalls, the most obvious ones being staking down the sides or connecting a length of cord of some sort therebetween at various points.

There remains, however, a very important function of the floor 16 that is not so commonplace and, in fact, is quite unique, namely, the fact that the floor always ends up forming the outside covering for the tent in folded condition. Moreover, it is always the underside of the floor which is exposed. Accordingly, all the clean areas are contained and protected inside the cover thus formed and only the dirty side of the floor that lay on the ground is exposed where it is easy to brush off, wash off and clean. This is not to say that many tents with integral floors cannot be folded in such a way that the exact same thing occurs because, obviously, they can. On the other hand, applicant is unaware of any tent where this occurs automatically everytime the tent is folded and, furthermore, it cannot be folded in such a way that this does not take place.

While the aforementioned functions of the floor are significant, they are not unique in tent construction. The walls 18 on the other hand, do have a structural significance which, so far as I am aware, is unknown in prior art tents. Before discussing the novel functional relationship between the tent walls and the frame covered thereby, it is necessary that one first explore in detail the construction and operation of the frame for which purpose reference will now be made to FIGS. 4–12, inclusive.

Figure 4:
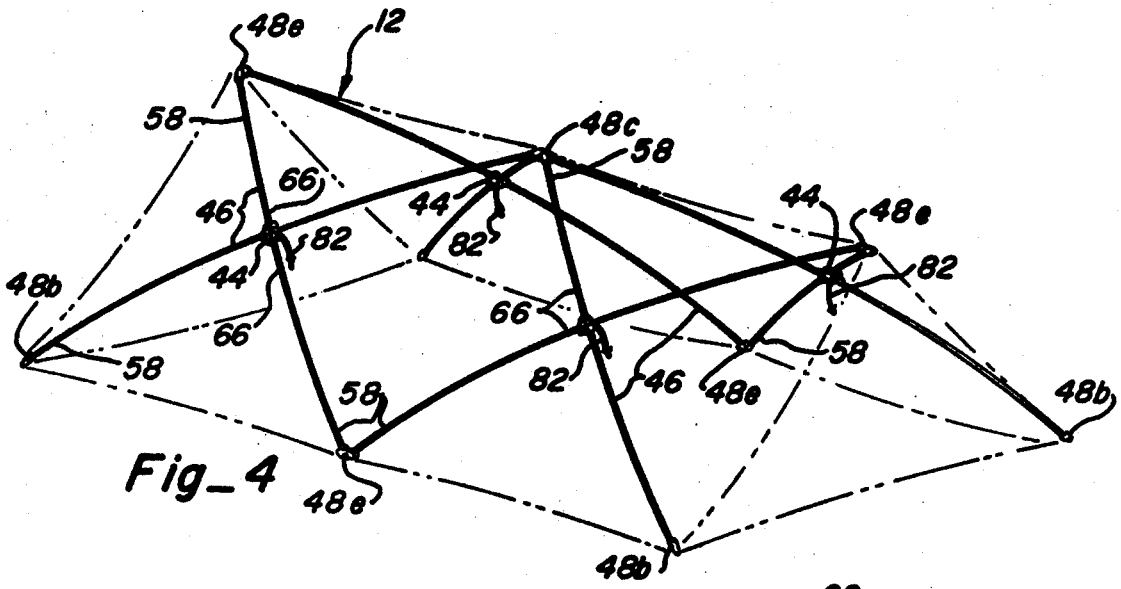
FIG. 4 is a perspective view to the same scale as FIGS. 2 and 3 showing the frame alone.
Figure 5:
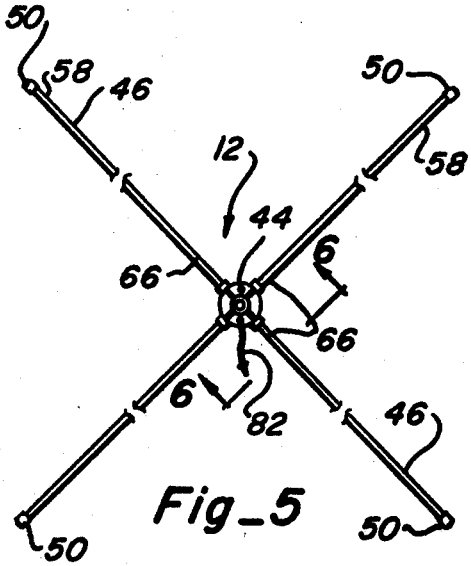
FIG. 5 is a fragmentary view to a larger scale than FIG. 4 showing the hub and struts of the subframes, portions of the stuts having been broken away to conserve space.

FIG. 4 reveals the frame or skeletal structure of what has been denominated here as the "double-length" version of the tent made up of four identical subframes 42 instead of just two. Each such subframe is hingedly attached to another like it to define an inverted generally V-shaped pair thereof while the two pairs are joined together in end-to-end relation as shown. At the center of each subframe is a novel hub 44 to which four identical rib-forming springable struts 46 are hingedly connected for independent movement from a folded condition where they nest in side-by-side relation to an unfolded operative one in which they radiate from the hub in arched or bowed equiangularly-spaced relation to one another. In the single instance where the four struts join at their outer or remote ends, a unique four socket connector 48c is used, as shown at the midpoint of the ridge 20. At the ends of the ridge and the midpoints of both sidewalls, a two socket connector 48*e* is used which, for purposes of simplicity, preferably comprises a four socket connector cut in half to accommodate two struts instead of four. In like manner, a single socket connector 48*b* made by cutting the four socket connector in fourths is used at the corners of the sidewalls.

The struts, in the particular form shown, comprise tubular plastic rods having metal caps 50 permanently affixed to at least one, and preferably both, ends thereof. As illustrated, these caps 50 are not spherical although they perform the exact same function as the balls of a ball and socket universal coupling. Instead, these caps have a more or less cylindrical shape except for their chamfered ends 52 that provide the bearing surfaces that rub against the spherical walls of the sockets 54 in which they move. Once again, no novelty is predicated upon the particular configuration of the ball and socket connections illustrated because any one of several well-known designs that provide for universal movement will work just as well. On the other hand, there are certain supplementary features which are both novel and significant functionally that deserve special mention.

Figure 7:
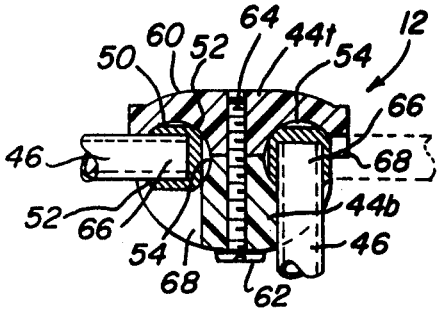
FIG. 7 is a section taken along line 7—7 of FIG. 6 and to the same scale as the latter.
Figure 6:
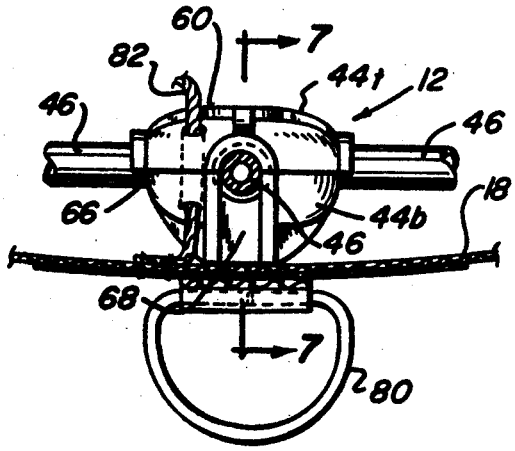
FIG. 6 is a still further enlarged fragmentary sectional view of the hub and strut connection at the center of each subframe.

Now, with particular reference to FIGS. 6 and 7, it will be seen that the struts 46 must swing through a 90° arc between their unfolded operative position shown in full lines and their folded inoperative or stored position in side-by-side nested relation shown in broken lines. A significant difference between the instant subframe construction and that of my previous patents should be pointed out here, namely, that the diagonally-disposed struts need not necessarily swing past center into an angular relationship that exceeds 180° as was the case with the rigid struts. Instead, contrary to my earlier teaching, I can limit the excursion of the opposed strut pairs to essentially a straight line or 180° angular relationship and rely upon the springiness of the individual struts to permit them to assume the necessary bowed condition revealed in FIGS. 1-4. In other words, while the remote ends 58 of the struts end up when fully unfolded in approximately the same over-center relationship to the hub as the rigid struts of my patented subframes, they do so because of the flexibility of the struts themselves not the location of the stop-forming marginal edges of the hub in relation to the hinge axes thereof. While the sections of the struts shown in FIGS. 6 and 7 are too short to reveal any bending thereof, in unfolded condition they will, in fact, be bowed or arched in the direction of the top of the sheet. Accordingly, it is surface 60 of the hub that lies exposed inside the tent while the opposite surface where screwhead 62 is shown lies adjacent the inside wall surface.

By eliminating the hinged connection between the struts and hub which, essentially, limits the movement of the struts to actuate movement in a single plane and replacing it with a universal ball and socket connection, I have left the subframe with an undesirable degree of freedom, namely, the freedom of the hub to rotate about the axis defined by the screw 64. Obviously, if hub 44 were allowed to rotate, the opposed strut pairs would move out of an essentially aligned into a side-by-side skewed relationship thus foreshortening the diagonal defined thereby and even, perhaps, causing the adjacent ends 66 to break out or otherwise come loose from their sockets 54. Moreover, as will appear presently, it is one of the most significant features of the instant invention that the fabric 18 covering the subframes functions, at least in the unfolded state thereof, to maintain the struts under compression so that the adjacent and remote ends thereof remain securely seated in their respective hub and connector sockets 54. Obviously, under this kind of loading tending to push the struts deeper into the hub sockets, the tendency for the hub to rotate and relieve this pressure is pronounced. While provision should be made for eliminating this tendency, fortunately, it can and has been done quite simply and easily.

In FIGS. 6 and 7 it will be seen that hub 44 is molded in two parts (44*t* and 44*b*) which cooperate with one another in assembled relation to define narrow strut-receiving channels 68 of approximately the same width as the diameter of the strut. The angular extent of these channels is 90° as shown although this angle is by no means critical and it could for this reason vary a few degrees one way or the other without materially effecting the operation of the subframe. These channels are, of course, spaced apart angularly 90° also so as to accommodate the four struts. Elements 44*t* and 44*b* also cooperate with one another when assembled to define the ball-receiving socket 54 at the apex of the channel, this socket being merely an enlargement of the latter sized to receive and shaped to retain ball 50. The socket, of course, encompasses a 270° arc while the channel takes up the remaining 90°. The elements 44*t* and 44*b* of the hub are held in assembled relation by screw 64 which, in the preferred embodiment of the invention is also used to fasten the hub to the sidewall of the tent. Thus, by confining the struts to essentially coplanar movement despite their universal ball and socket connection, the problem of hub rotation under load is eliminated.

The hub and its connection to the tent skin and to the struts is far more important than the manner in which the remote strut ends 58 are attached to the skin, nevertheless, I have developed molded connectors for this purpose that are worthy of specific mention, especially the one shown in FIGS. 8, 9 and 10 to which detailed reference will now be made. Now, while sewn pockets of the type commonly provided as means for receiving and retaining the cornerposts and roof frame struts of conventional tents can, as an alternative, be used to fasten the skin to the remote ends 58 of the instant struts 46, I much prefer the use of a prefabricated connector 48 for this purpose. It should be mentioned that all or a portion of hub 44 could be used to fasten the remote strut ends to the tent skin in place of connector 48; however, the maximum angle through which the struts of adjacent subframes must swing relative to one another is not nearly so great as that through which the struts of the same subframe must swing at the hub; therefore, hub 44 is somewhat overdesigned for the job it needs to perform as a remote end connector. Conversely, four-socket connector 48*c* of FIGS. 8, 9 and 10 could function as hubs for the subframes, the only problem being that it does not provide quite the same degree of confinement of the strut end that will insure against rotation under compression load as the channel 68 of hub 44. Be that as it may, if the compression loading on the struts is minimal or, alternatively, the connector 46*c* is secured to the tent wall in such a manner that it cannot rotate, it could be used as a hub in place of hub 44.

Connector 48*c* comprises a one piece molded part having four equiangularly-spaced more or less bullet-shaped sockets 54*m* opening outwardly from one face of an integrally-formed foldable web 70. Instead of these sockets 54*m* opening radially in parallel relation to web 70, they preferably are all pre-tilted in the same direction twenty degrees or so as shown thus reducing the extent to which the web separating them must flex and fold in order for them to assume the 45° tilt shown in FIG. 8 or the 75°-80° tilt they will ultimately lie in when the struts are folded into nested essentially parallel relationship to one another, the latter being the condition of the connector shown in FIG. 10.

To facilitate folding of the web, radially-extending grooves 72 are preferably provided midway between the sockets. As the sidewalls of the tent drape down over the connector as shown in FIG. 8, pleats 74 form between the sockets as shown in FIG. 10 when they move down and closer together. While, conceivably, the fold in the web can occur on either face thereof and, in fact, would most likely occur on the face thereof opposite the sockets, the weight of the skin 18 draped down over the latter along the ridge 20 will, under most circumstances, cause the pleat 74 to be made on the same side as the sockets. In the fully folded condition of the tent where the struts lie essentially parallel to one another, the centerlines of the sockets still occupy a divergent angular relationship because there is some tilt of the strut within the socket that can occur and, furthermore, the walls of the sockets themselves will flex to a degree which will accommodate even more. For instance, as shown in broken lines in FIG. 8, the struts are parallel, yet, the sockets have folded toward one another only a few degrees beyond the 45° tilt they have when fully unfolded.

Only one four-socket connector 48*c* is needed, specifically at the midpoint of the ridge 20 where one strut of each of the four subframes comes together. Two-socket connectors 48*c* comprise the four-socket ones cut in half. The grooves 72 in the web 70 facilitate cutting the four-socket units 48*c* in half or in quarters to form the single-socket connectors 48*b* used in the corners where the sidewalls join the floor. Two-socket connectors are, of course, required at the ends of the ridge in both the double and single-length versions of the tent as well as the midpoint of the sidewalls of the double-length unit where they join the floor. If connectors 48 or all or some fractional part of hub 44 is used to receive the remote ends of the struts, they should be equipped with balls or the equivalent fittings 50. In fact, capping the remote strut ends is a good idea even when sewn pockets are used in place of other connectors just to keep the struts from puncturing or wearing a hole in the covering.

Figure 8:
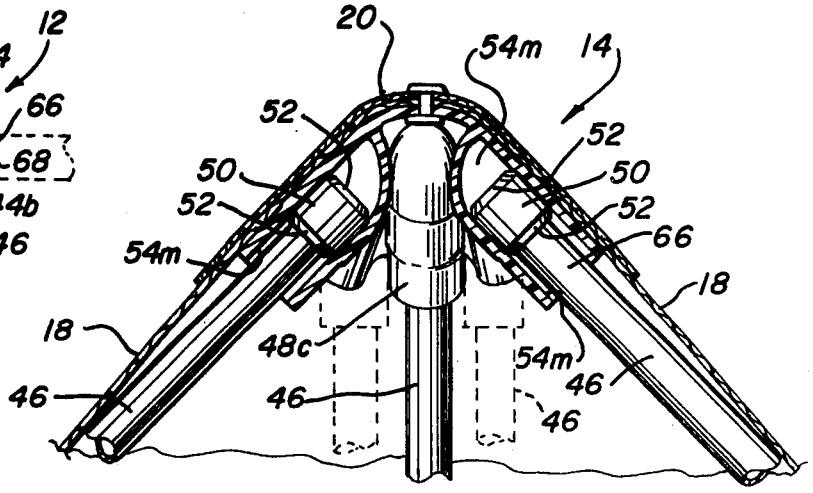
FIG. 8 is a fragmentary section taken along line 8—8 of FIG. 3 and to the same scale as FIGS. 6 and 7 showing the connector and strut assembly at the center of the ridge in the double length version of the tent.
Figure 10:
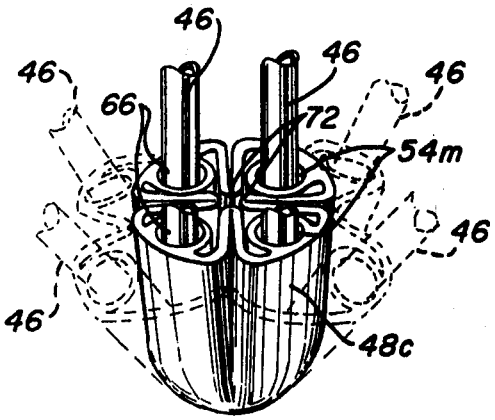
FIG. 10 is a perspective view of the center ridge connector illustrating the manner in which the webs between the sockets fold into a pleat-forming relation when the struts are brought into a folded position alongside one another.
Figure 9:
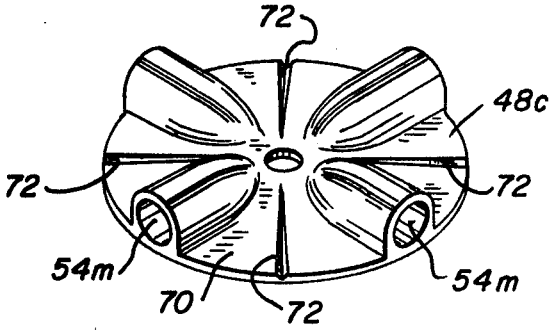
FIG. 9 is a perspective view of the center ridge connector of FIG. 8.
Figure 12:
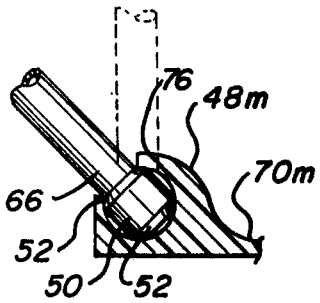
FIG. 12 is a fragmentary section taken along line 12—12 of FIG. 11.
Figure 11:
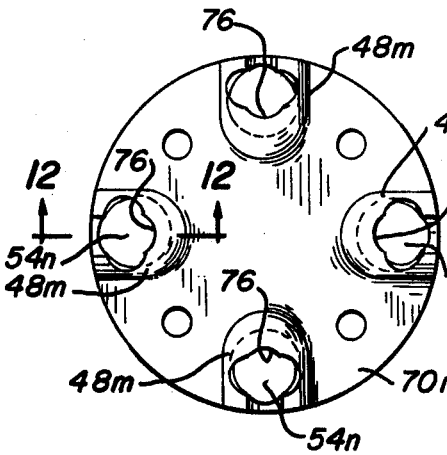
FIG. 11 is a bottom plan view showing a modified version of the strut end connector.
Figure 13:
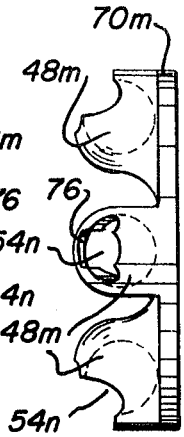
FIG. 13 is an elevational view of the modified strut end connection of FIG. 11 and 12.
Figure 2:
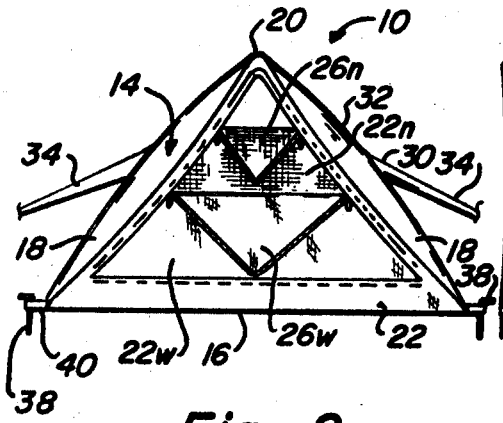
FIG. 2 is a front elevation to a reduced scale.
Figure 3:
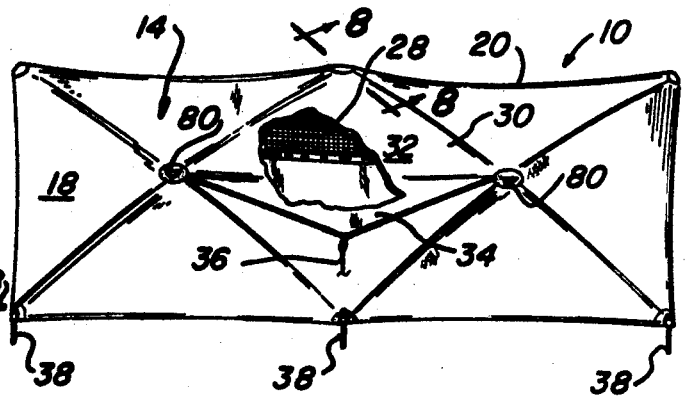
FIG. 3 is a side elevation to the same scale as FIG. 2, portions of the weather fly having been broken away to reveal the breathable skin therebeneath.

FIGS. 11 and 12 show a slightly modified form of connector 48*m* which is used in exactly the same way as the one just described which forms the subject matter of FIGS. 8, 9 and 10. In this one, however, the web 70*m* is a good deal thicker and is not designed to fold. This means, of course, that the grooves 72 are no longer necessary other than, perhaps, to facilitate cutting the unit in to halves or quarters.

Since the web is not designed to fold, the sockets 54*n* are shaped to permit the movement of the struts from the divergent relation shown in full lines in FIG. 8 into the nested essentially parallel relation shown in broken lines. This is accomplished by providing the wall of the sockets remote from the web atop which they sit with a semi-circular cut-out 76 sized to accommodate the strut in perpendicular relation. The sockets 54*n* are located on one face of the web as was the situation with the previously-described connector; however, instead of depending upon the folding of the web to place the centerlines thereof in the approximately 45° inclined relation they must occupy in the unfolded condition illustrated in FIG. 8, their centerlines are pre-tilted into this position during manufacture as is clearly revealed by the angle of the strut shown in full lines in FIG. 12. In this same figure, the broken lines show the strut seated in cut-out 76 where those attached to the connector will occupy a nested relationship lying alongside one another.

The connector of FIGS. 11 and 12 produces a somewhat larger disc over which the tent must be draped than either connector 48 or hub 44 when the latter is used at the remote ends of the struts and, for this reason, is somewhat less desirable albeit effective for its intended purpose. Also, it does not offer the restraint against rotational movement with the struts unfolded that both the other connector and hub design provide and, for this reason, it is preferably attached to the skin of the tent in such a way that rotational movement is prevented. On the positive side, connector 54*n* is somewhat less expensive and easier to mold than either of the others although the number of such connectors required when compared with the cost of the other elements of the tent makes any cost saving in this area largely negligible.

Returning once again to FIGS. 1–4 and 8 of the drawings, the significant feature to note is that both the adjacent and remote ends of each strut are seated in some kind of a socket and the element containing the socket is, in turn, attached in fixed position to the skin 18 of the tent. Moreover, the fabric between these socket-containing elements, whether they be hubs or connectors or sewn pockets or some of each, is stretched taut so as to not only keep the strut ends securely seated but, more importantly, to maintain the struts themselves under a degree of compression loading most especially when the subframes are fully unfolded as shown. Saying this another way, the spacing between the sockets that receive the remote ends of the diagonal-forming struts of each subframe are spaced apart a distance less than the combined lengths of the latter so that the fabric stretched taut therebetween becomes effective to maintain them in the bowed condition most clearly revealed in FIG. 4 without having to use an elastic cord or the like connecting the remote ends together as in my patented tents. Now, while the pockets at the remote ends of the diagonal-forming struts are, themselves, capable of maintaining the struts in bowed relation when fully unfolded, they become ineffective to keep the adjacent and remote ends of the individual struts seated securely in their sockets when the tent is folded. In order to accomplish the latter objective, the hub at the center of each subframe must also be connected to the skin of the tent in fixed position. By so doing, the hub cooperates with the pocketed members on the remote ends of the struts and with the fabric stretched taut therebetween to keep the strut ends securely seated within their respective sockets both in the unfolded and folded attitudes as well as all positions between the two. In addition, these attached hubs provide the most convenient means for setting up and taking down the tent which can be accomplished from either the inside or the outside. If inside, one need only press outwardly on the hubs of a pair of the opposed subframes until they pass across the straight line defined by the remote ends of the diagonal-forming strut pairs, whereupon, the spring in the struts will immediately "pop" the hub over center at which point the fabric and associated subframes assume an umbrella-like configuration. If the tent is a double-length version like that illustrated, the procedure must be repeated for the other pair of opposed fabric-covered subframes. By connecting the hubs to the skin covering same with some means accessible on the exterior like D-rings 80, one can erect the tent from the outside by merely pulling upon the ones on opposite sides of the tent at the same end simultaneously. Of course, reversing these simple procedures folds the tent into a compact package having an overall length that is just slightly longer than the struts.

One other aspect of the tent is worthy of specific mention and that is the need for the width of the floor 16 to materially exceed the slant height of the sidewalls so that the tent will fold up. The hubs 44 on opposite sides of the tent at the same end will lie side-by-side when the tent is folded with the fabric covering their respective subframes folded up within that bundle of four struts nested therearound. Outside of this bundle of struts will be the envelope formed by the tent floor which must, of course, contain enough area to completely cover same thus folded because it remains attached thereto. In general, the width of the floor must be a little over twice the length of the individual struts.

Means 82 attached to the inside of the hubs for the purpose of collapsing the subframes inwardly are preferably also provided in addition to the external D-rings or the like. In the particular form shown, the means 82 comprises a short length of cord although, obviously, another D-ring can be used or anyone of a number of other handle-forming appurtenances.

The springability of the struts is functionally significant for yet another reason, namely, it simplifies the initial assembly of the tent. The fabric skin can be sewn and the hubs 44 and connectors 48 permanently fastened thereto before the struts are added to complete the subframes because the latter need only be bowed to the extent when the adjacent and remote ends thereof move close enough together to enter their respective sockets. Once released, the struts stretch the fabric taut and the fabric, in turn, maintains the struts deeply seated in their sockets as well as under a slight compression load.

What is claimed is:

1. In a tent structure, a pair of rectangular wall-forming subassemblies each of which includes an X-shaped subframe, said subassemblies having the upper marginal edges thereof hingedly interconnected, both of said subframes including a centrally-located hub together with four springable struts having adjacent ends connected to said hub for movement between a folded position nested together in side-by-side bundle-forming relation and an unfolded position radiating diagonally therefrom in angularly-spaced relation to one another, and each of said wall-forming subassemblies also including foldable means stretched taut between the ends of the struts remote from the hub cooperating therewith to maintain said struts in fixed angularly-spaced relation and bowed in a stable umbrella-like fashion when unfolded.

2. The tent structure as set forth in claim 1 wherein the wall-forming subassemblies are square and the subframe struts are spaced apart angularly approximately 90°.

3. The tent structure as set forth in claim 1 wherein a second pair of hingedly interconnected wall-forming subassemblies substantially identical to the first pair thereof is connected to the latter in end-to-end relation.

4. The tent structure as set forth in claim 1 wherein socketed connectors are fastened to the foldable means in position to receive the remote strut ends, the sockets in said connectors being shaped to permit limited pivotal movement of said struts through the angle necessary to accommodate folding and unfolding the subframe.

5. The tent structure as set forth in claim 1 wherein the foldable means makes substantially continuous line contact with each bowed strut.

6. The tent structure as set forth in claim 1 wherein the foldable means and hub cooperate to maintain opposite struts in each subframe in substantially coplanar relation and bowed to define a continuous arch when unfolded.

7. The tent structure as set forth in claim 1 wherein the foldable means comprises a rectangular sheet of non-elastic material covering the struts and hub.

8. The tent structure as set forth in claim 7 in which a single sheet of material covers both subframes of the pair of wall-forming subassemblies.

9. The tent structure as set forth in claim 1 in which a sheet of foldable material interconnects the marginal edges of the wall-forming subassemblies remote from the hinged connection therebetween effective to maintain said edges in a maximum spaced substantially parallel relation one another.

10. The tent structure as set forth in claim 9 in which the struts in the subframes of both wall-forming subassemblies are the same length, and the width of the sheet interconnecting the marginal edges of said subassemblies measured therebetween is not less than twice the length of the struts.

11. The tent structure as set forth in claim 1 in which: the foldable means covers the hub and is connected thereto, and in which said hub and foldable means cooperate with one another to maintain the struts under compression in all positions thereof.

12. The tent structure as set forth in claim 11 in which the points of attachment of the foldable means to the hub and a particular strut are spaced apart a distance less than the length of the latter.

13. The tent structure as set forth in claim 1 wherein the connection between the struts and hub comprises a ball and socket joint.

14. The tent structure as set forth in claim 13 wherein the hub contains the socket and said socket is shaped to confine the strut to essentially coplanar movement as it pivots between folded and unfolded position.

15. In a tent structure, a pair of wall-forming subassemblies each of which includes an X-shaped subframe, said subassemblies having the upper marginal edges thereof hingedly interconnected, both of said subframes including a centrally-located hub together with four springable struts having adjacent ends connected to said hub for movement between a folded position nested together in side-by-side bundle-forming relation and an unfolded position radiating diagonally therefrom in angularly-spaced relation to one another, each of said wall-forming subassemblies also including foldable means stretched taut between the ends of the struts remote from the hub cooperating therewith to maintain said struts in fixed angularly-spaced relation and bowed in a stable umbrella-like fashion when unfolded, and said wall-forming subassemblies further including socketed connectors interconnected by a flexible web fastened to the foldable means in position to receive the remote strut ends, the sockets in said connectors being shaped to permit limited pivotal movement of said struts through the angle necessary to accommodate folding and unfolding the subframe, and said flexible web being adapted to fold and form a pleat between said sockets upon movement thereof toward a parallel relation.

16. The tent structure as set forth in claim 15 wherein the socketed connectors are non-rotatably fastened to the foldable means.

17. The tent structure as set forth in claim 15 in which the struts have ball-like enlargments on the remote ends thereof and said enlargements cooperate with the sockets in the socketed connectors to define snap-in type ball and socket joints.

18. The tent structure as set forth in claim 15 in which the depth of the sockets is selected such that with a remote strut end seated in the bottom thereof, the portions of said socket bordering the opening therein will be effective to define stops cooperating with a like socket opening in the opposite direction to prevent said connector from rotating to a point where the struts will move into a skewed relation.

19. The tent structure as set forth in claim 15 wherein the socketed connectors comprise a substantially flat base atop one surface of which are formed at least two angularly-spaced sockets opening upwardly at an acute angle relative to said base.

20. The tent structure as set forth in claim 19 in which the edge of the sockets bordering the opening therein is notched opposite the base to receive the strut and prevent side-to-side movement thereof.

* * * * *